US009447794B2

(12) United States Patent
Casavant

(10) Patent No.: US 9,447,794 B2
(45) Date of Patent: Sep. 20, 2016

(54) INDUCER AND DIFFUSER CONFIGURATION FOR A GAS TURBINE SYSTEM

(71) Applicant: General Electric Company, Schenectady, NY (US)

(72) Inventor: Matthew Stephen Casavant, Greenville, SC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 452 days.

(21) Appl. No.: 14/011,611

(22) Filed: Aug. 27, 2013

(65) Prior Publication Data

US 2015/0063996 A1 Mar. 5, 2015

(51) Int. Cl.

| | |
|---|---|
| ***F04D 29/44*** | (2006.01) |
| ***F01D 25/24*** | (2006.01) |
| ***F01D 9/04*** | (2006.01) |

(52) U.S. Cl.

CPC ..... *F04D 29/441* (2013.01); *F01D 9/041* (2013.01); *F01D 25/24* (2013.01); *F05D 2240/127* (2013.01)

(58) Field of Classification Search

USPC ..... 415/108, 115, 116, 117, 207, 224, 415/224.5; 60/269

See application file for complete search history.

(56) References Cited

U.S. PATENT DOCUMENTS

| | | | | |
|---|---|---|---|---|
| 4,807,433 | A * | 2/1989 | Maclin | F01D 5/081 415/115 |
| 5,245,821 | A | 9/1993 | Thomas, Jr. et al. | |
| 6,050,079 | A * | 4/2000 | Durgin | F02C 7/125 415/115 |
| 6,183,195 | B1 * | 2/2001 | Tremaine | F04D 29/4213 415/1 |
| 6,526,751 | B1 * | 3/2003 | Moeckel | F02B 29/0475 60/599 |
| 6,540,477 | B2 * | 4/2003 | Glynn | F01D 5/081 415/115 |
| 6,672,072 | B1 * | 1/2004 | Giffin, III | F01D 5/08 60/728 |
| 2009/0047134 | A1 | 2/2009 | Chen et al. | |
| 2012/0087784 | A1 | 4/2012 | Widener | |

* cited by examiner

*Primary Examiner* — Binh Q Tran
(74) *Attorney, Agent, or Firm* — Fletcher Yoder, P.C.

(57) ABSTRACT

A system includes at least one inducer including a flow passage configured to guide a fluid flow into a cavity defined by a casing and rotor of a gas turbine engine, the flow passage includes an inlet configured to receive the fluid flow from a compressor diffuser of the gas turbine engine, and an outlet configured to discharge the fluid flow into the cavity. The at least one inducer is configured to be disposed within the gas turbine engine so that the second outlet is axially disposed forward of a diffuser outlet of the compressor diffuser.

15 Claims, 4 Drawing Sheets

INDUCER AND DIFFUSER CONFIGURATION FOR A GAS TURBINE SYSTEM

BACKGROUND

The subject matter disclosed herein relates to gas turbines and, more particularly, to a flow inducer for gas turbines.

Gas turbine engines typically include a number of subsystems, such as compression systems, combustion systems, power turbine systems, and cooling systems. Each subsystem may be helpful in increasing the power output and/or efficiency of the gas turbine engine. Increasing the dimensions of a subsystem, for example, may increase the power output and/or efficiency of that subsystem, and the gas turbine engine as a whole. In certain applications, however, there may be restrictions on the dimensions of the total footprint of the gas turbine. These dimensional restrictions may include the longitudinal length of the gas turbine. As a result of such dimensional restrictions, it may be difficult to increase the power output and/or efficiency of any particular subsystem, much less the entire gas turbine engine.

BRIEF DESCRIPTION

Certain embodiments commensurate in scope with the originally claimed invention are summarized below. These embodiments are not intended to limit the scope of the claimed invention, but rather these embodiments are intended only to provide a brief summary of possible forms of the invention. Indeed, the invention may encompass a variety of forms that may be similar to or different from the embodiments set forth below.

In accordance with a first embodiment, a system includes a gas turbine engine having a compressor, a turbine, a casing, and a rotor. The casing and the rotor are disposed between the compressor and turbine, and the casing and the rotor define a cavity to receive a fluid flow from the compressor. The gas turbine also includes a diffuser disposed aft of the compressor. The diffuser is configured to receive the fluid flow from the compressor, and the diffuser includes a first inlet proximate the compressor and a first outlet distal from the compressor. The gas turbine engine also has an inducer assembly including at least one inducer. The at least one inducer includes a flow passage configured to guide the fluid flow into the cavity, the flow passage includes a second inlet configured to receive the fluid flow and a second outlet configured to discharge the fluid flow into the cavity, and the second outlet is axially disposed forward of the first outlet of the diffuser.

In accordance with a second embodiment, a system includes a gas turbine engine having a compressor, a turbine, a casing, and a rotor. The casing and the rotor are disposed between the compressor and turbine, and the casing and the rotor define a cavity to receive a fluid flow from the compressor. The gas turbine also includes a diffuser disposed aft of the compressor. The diffuser is configured to receive the fluid flow from the compressor, the diffuser is defined by a first wall and a second wall, the first wall being radially disposed more proximate to a longitudinal axis of the gas turbine engine than the second wall, and the diffuser includes a first inlet proximate the compressor and a first outlet distal from the compressor. The gas turbine also has an inducer assembly including at least one inducer. The first wall is disposed between the diffuser and the at least one inducer, the at least one inducer includes a flow passage configured to guide the fluid flow into the cavity. The flow passage includes a second inlet configured to receive the fluid flow and a second outlet configured to discharge the fluid flow into the cavity. The second inlet and the second outlet are radially disposed more proximate to the longitudinal axis of the gas turbine engine than the first wall.

In accordance with a third embodiment, a system includes at least one inducer including a flow passage configured to guide a fluid flow into a cavity defined by a casing and rotor of a gas turbine engine, the flow passage includes an inlet configured to receive the fluid flow from a compressor diffuser of the gas turbine engine, and an outlet configured to discharge the fluid flow into the cavity. The at least one inducer is configured to be disposed within the gas turbine engine so that the second outlet is axially disposed forward of a diffuser outlet of the compressor diffuser.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements.

The present disclosure is generally directed towards a gas turbine engine with an inducer assembly for providing a cooling flow in a cavity of the gas turbine engine. The inducer directs cooling flow from the compressor of a gas turbine engine to other parts of the engine. Compressed air/gases flow through a diffuser which increases the pressure of the gases before they are mixed with fuel and combusted in the combustor. The inducer diverts a portion of the compressed air before it is combusted as a cooling flow. Rather than simply fitting the inducer at the end of the diffuser, the inducer is packaged in such a way that it is forward of an exit of a diffuser flowpath. Thus, air exiting the diffuser is directed back toward the compressor section of the gas turbine before flowing through the inducer into the cooling paths throughout the rest of the engine.

Figure 1:
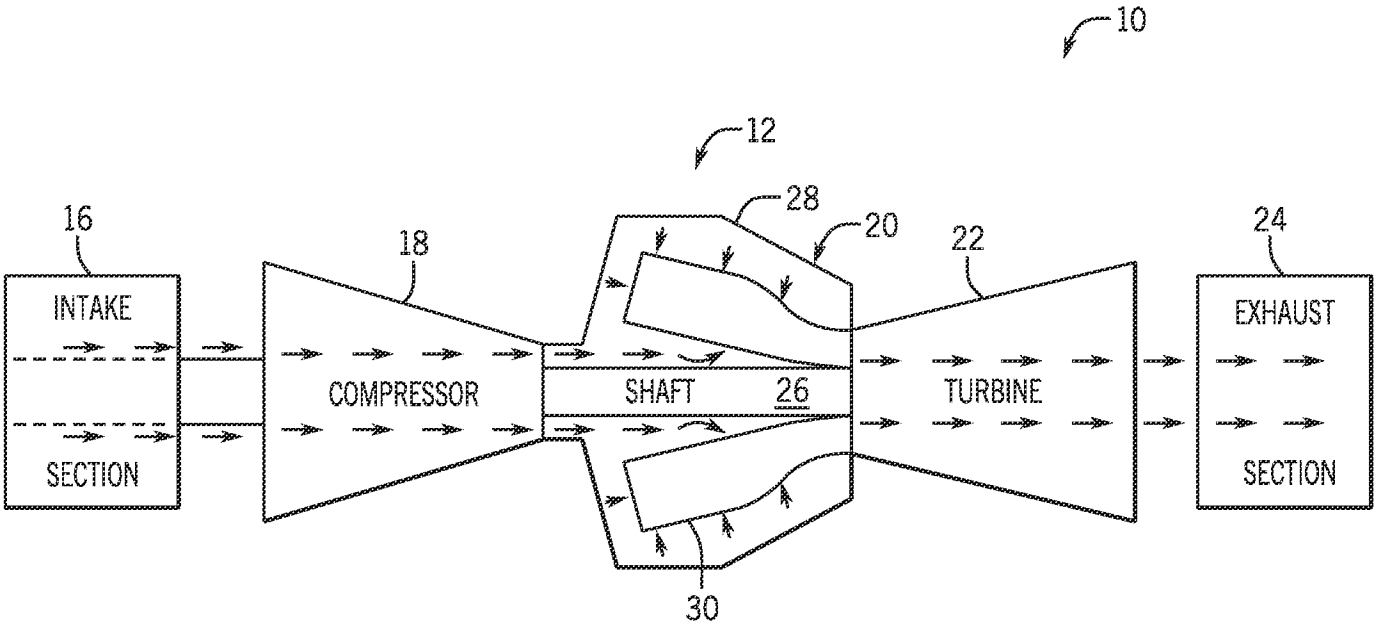
FIG. 1 is a schematic flow diagram of an embodiment of a gas turbine engine that may employ flow inducers.

FIG. 1 is a block diagram of a system 10 that includes a gas turbine engine 12 that may employ one or more inducers (e.g., inducer assembly) configured to direct cooling fluid to a cavity within the gas turbine engine 12, as described in detail below. In certain embodiments, the system 10 may include an aircraft, a watercraft, a locomotive, a power generation system, or combinations thereof. The illustrated gas turbine engine 12 includes an air intake section 16, a compressor 18, a combustor section 20, a turbine 22, and an exhaust section 24. The turbine 22 is coupled to the compressor 18 via a shaft 26.

As indicated by the arrows, air may enter the gas turbine engine 12 through the intake section 16 and flow into the compressor 18, which compresses the air prior to entry into the combustor section 20. The illustrated combustor section 20 includes a combustor housing 28 disposed concentrically or annularly about the shaft 26 between the compressor 18 and the turbine 22. The compressed air from the compressor 18 enters combustors 30, where the compressed air may mix and combust with fuel within the combustors 30 to drive the turbine 22.

From the combustor section 20, the hot combustion gases flow through the turbine 22, thereby driving the compressor 18 via the shaft 26. For example, the combustion gases may apply motive forces to turbine rotor blades within the turbine 22 to rotate the shaft 26. After flowing through the turbine 22, the hot combustion gases may exit the gas turbine engine 12 through the exhaust section 24. As discussed below, the turbine 22 may include one or more inducers 29 forward of a diffuser 34 (e.g., compressor diffuser region 34). The diffuser 34 may diffuse the gas that has been compressed by the compressor 18, which increases the pressure and prepares the gas to flow to the combustor 30 and be mixed with fuel and combusted. The diffuser 34 may also direct cooling fluid to cool the shaft 26 and the turbine 22. Placing the one or more inducers 29 forward of the diffuser 34 enables the overall length and width of the gas turbine engine 12 to be shortened (e.g., longitudinally and radially), allowing the system 10 to operate in a smaller space.

Figure 2:
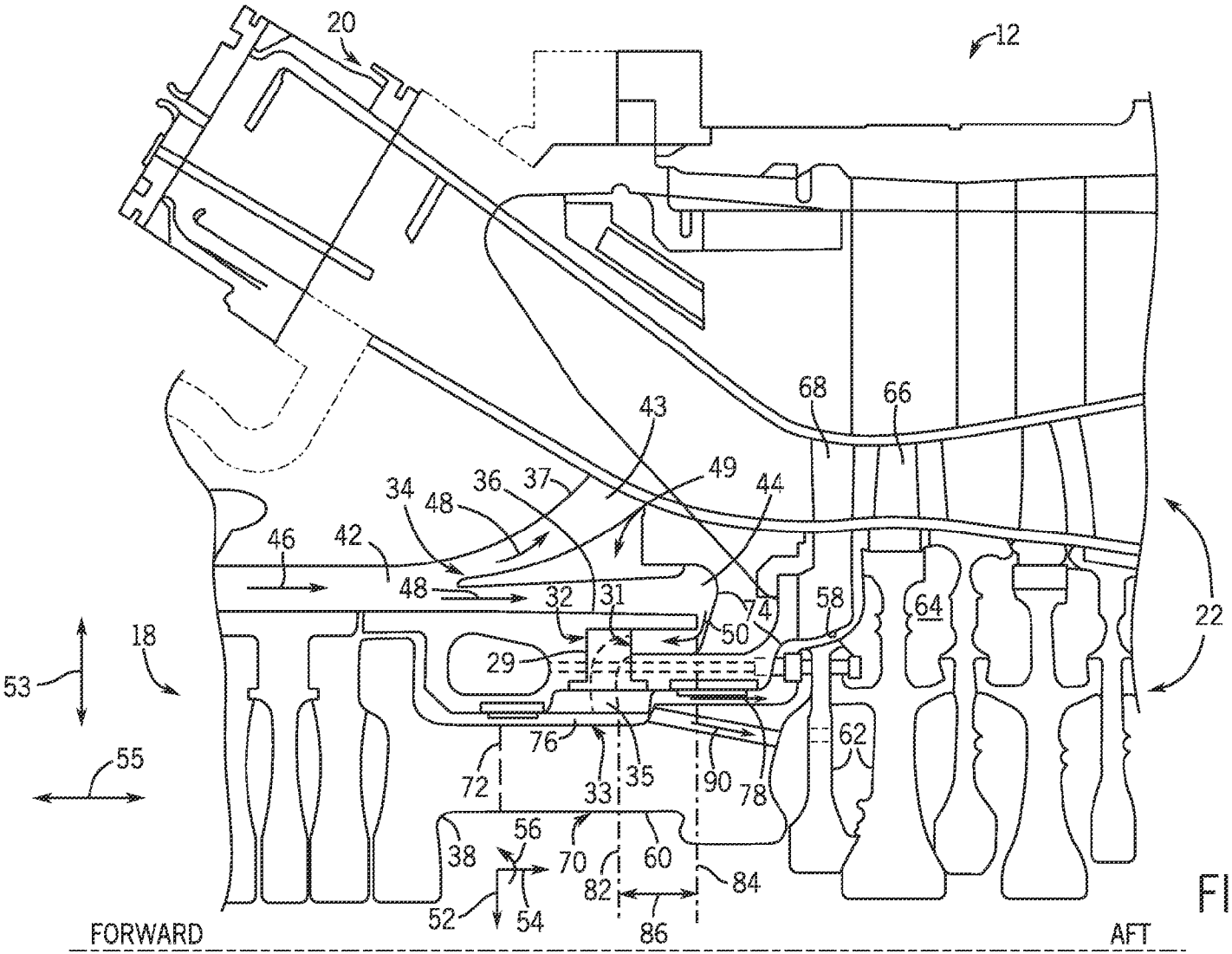
FIG. 2 is a partial cross-sectional side view of an embodiment of the gas turbine engine of FIG. 1 that includes an inducer assembly having at least one flow passage or inducer (e.g., axial or radial inducer)

FIG. 2 is a partial cross-sectional side view of an embodiment of a portion of the gas turbine engine 12 having a fluid flow inducer assembly 32 having one or more inducers 29 (e.g., axial or radial inducer) for routing cooling fluid flow (e.g., air flow) toward the turbine section 22 of the engine 12. Although discussed in relation to a gas turbine engine 12, the inducer assembly 32 or its inducers 29 may be used in other applications. As described above, the gas turbine engine 12 includes the compressor 18, the combustor section 20, and the turbine 22. The compressor 18 and the turbine 18 are coupled together by the rotor as described below. The compressor 18 includes a first wall 36, a portion of which may be known as a compressor discharge casing or compressor stator component, and an inner rotor component 38 (e.g., compressor rotor). A diffuser 34 at least partially defined by the first wall 36 and a second wall 37, which may also be known as an outer casing, is located aft or downstream of the compressor 18. The first wall 36 defines the inner boundary of the diffuser 34, meaning that the first wall 36 defines a boundary that is closer to a longitudinal axis 80 than the second wall 37. The illustrated first wall 36 may be generally straight (e.g., parallel to the axis 80), such that the first wall 36 has a cylindrical or annular shape. The second wall 37 defines the outer boundary of the diffuser 34. The second wall 37 diverges from the longitudinal axis 80 as it moves in the axial direction 54, such that the second wall 37 has a diverging annular shape. The shape of either the first wall 36 or the second wall 37 may be different than shown in FIG. 2. For instance, the first wall 36 may be angled in the radial direction 52 (e.g., converging toward or diverging away from the longitudinal axis 80) as it moves in the axial direction 54. Also, the second wall 37 may include a cylindrical shape. However, in certain embodiment, the first and second walls 36 and 37 of the diffuser 34 may generally diverge from one another in the downstream axial direction 54, thereby causing diffusion of the compressed air flow in the axial and/or radial directions 54 and 52. Thus, the first and second walls 36 and 37 of the diffuser 34 may generally define an expanding annular passage.

The diffuser 34 includes an inlet 42 (e.g., annular opening or passage) proximate the compressor 18, and a first outlet 43 (e.g., annular opening or passage) and a second outlet 44 (e.g., annular opening or passage) at the distal end of the diffuser 34, away from the compressor 18. A fluid (e.g., air and/or another gas), referred to as a fluid flow 46, travels through and is pressurized within the compressor 18. The diffuser 34 guides a portion of the fluid flow 46 in a longitudinal direction 54 and slightly away from a radial direction 52 along a passage 48 (e.g., annular passage) adjacent the second wall 37 and through the first outlet 43 to the combustors 20. In addition, the diffuser 34 guides another portion 50 of the fluid flow 46 in the longitudinal direction 54 along a passage 48 (e.g., annular passage) adjacent to the first wall 36. As illustrated, the passages 48 may be separated from one another by a divider or spreader 49 (e.g., an annular spreader) disposed between the walls 36 and 37 in a coaxial arrangement. The spreader 49 may diverge in the downstream axial direction 54, thereby helping to guide the fluid flows along the walls 36 and 37. Again, the first fluid flow (e.g., air) flows along the wall 37 at an angle radially away from the axis 80, while the second fluid flow (e.g., air) flows along the axis 80. Afterwards, the fluid flow portion 50 passes through the second outlet 44 in an inward radial direction 52 toward the axis 80, and then in an upstream axial direction opposite the downstream axial direction 54 towards the inducer assembly 32.

The turbine 22 includes a turbine stator component 58 and an inner rotor component 60 (e.g., turbine rotor). The rotor component 60 may be joined to one or more turbine wheels 62 disposed in a turbine wheel space 64. Various turbine rotor blades 66 are mounted to the turbine wheels 62, while turbine stator vanes or blades 68 are disposed in fixed positions in the turbine 22. The rotor blades 66 and the stator blades 68 form turbine stages. The adjoining ends of the compressor rotor 38 and the turbine rotor 60 may be joined (e.g., bolted together) to each other to form an inner rotary component or rotor 70. A rotor joint 72 may join the adjoining ends of the rotors 38, 60. The adjoining ends of the first wall 36 and the turbine stator component 58 may be coupled to each other (e.g., bolted together) to form an outer stationary casing 74 surrounding the rotor 70. In certain embodiments, the first wall 36 and the turbine stator component 58 form a singular component without using flanges or joints to form the casing 74. Thus, the components of the compressor 18 and the turbine 22 define the rotor 70 and the casing 74. As illustrated, the compressor and turbine components define a cavity 76 (e.g., annular cavity). However, depending on the location of the inducer assembly 32 or inducers 29, the cavity 76 may be defined solely by turbine components. For example, the inducer assembly 32 or inducer 29 may be disposed between turbine stages.

In the disclosed embodiments, the inducer assembly 32 facilitates cooling of the wheel space 64 and/or rotor joint 72. The inducer 29 may be any type of inducer, including integrated inducers formed as a hole or passage in the casing 74. The inducer 29 may also include modular inducers that are formed to fit within the casing 74 and configured to be removed or replaced during servicing operations. In particular, in order to cool the turbine 22 and/or other parts of the gas turbine engine 12, the inducer 29 receives a portion 50 of the fluid flow 46 from the compressor 18 through an inducer inlet 31. The inducer inlet 31 may be adjacent to the distal end of the first wall 36 or may be further away from the end of the first wall 36 as shown in FIG. 2. Thus, the fluid flow portion 50 may flow around the first wall 52 in the radial direction 52 and then back in an upstream axial direction opposite the downstream axial direction 54 before entering the inducer inlet 31. Thus, the inducer 29 may be characterized as being underneath (e.g., radially inward from) the first wall 36. Following the inducer inlet 31, the fluid flow portion 50 leads through a flow passage 35 defined by inner boundaries of the inducer 29. The flow passage 35, as illustrated, directs the fluid flow portion 50 generally in the radial direction 52. The fluid then exits the inducer assembly 32 through the inducer outlet 33 and directs the fluid flow portion 50 into the cavity 76 to generate a cavity fluid flow 78. The inducer outlet 33 may be positioned at a first longitudinal location 82 along the longitudinal axis of rotation 80. The outlet 44 of the diffuser 34, meanwhile, may be positioned at a second longitudinal location 84, such as the illustrated position at the end of the first wall 36. The position of the inducer 29 may be underneath the first wall 36 in the radial direction 52.

As shown in FIG. 2, the first longitudinal location 82 may be forward (i.e., upstream of) the second longitudinal location 84. That is, the first longitudinal location 82 may be axially closer to the compressor 18 and axially further from the turbine 22. An overlap distance 86 shows the axial distance that the inducer assembly 32 is forward of the outlet 44 (i.e., the axial distance between the first 82 and second 84 longitudinal locations). The overlap distance 86 is not restricted only to the distance discernible from FIG. 2. The overlap distance 86 between the locations (i.e., first longitudinal location 82 and second longitudinal location 84) may be any distance suitable for a particular gas turbine engine 12. For example, the overlap distance 86 may be zero, whereby the inducer inlet 31 is axially aligned with the diffuser outlet 44 and the inlet 31 is axially aligned with the distal end of the first wall 36. However, in the illustrated embodiment, the inducer outlet 33 is positioned forward (i.e., axially upstream) of the diffuser outlet 44 to enable the inducer assembly 32 and diffuser 34 to occupy less longitudinal length 55. Additionally, the placement of the inducer assembly 32 underneath (e.g., radially inward from) the first wall 36 may enable the gas turbine engine 12 to occupy less radial 52 space, which reduces the height 53 of the inducer assembly 32 and/or the diffuser 34. Reducing the height 53 and length 55 of these sections (e.g., inducer assembly 32 and diffuser 34) of the gas turbine engine 12 enables the overall height and length of the gas turbine engine 12 to be reduced as well. Alternatively, the overall length of the gas turbine engine 12 may, of course, remain constant while the reduction in length of the diffuser/inducer is taken up by a proportional increase in the length of other sections of the gas turbine engine (e.g., intake 16, compressor 18, turbine 22, exhaust 24). Thus, the power output/unit length of the gas turbine engine 12 may be increased with the disclosed embodiment of the diffuser 34 and inducer assembly 32.

In certain embodiments, the inducer assembly 32 may receive the fluid flow portion 50 from a source (e.g., fluid flow source) external to the gas turbine 10 (e.g., waste fluid from an IGCC system). In addition, the inducer 29 directs the fluid flow portion 50 (e.g., inducer fluid flow) in a substantially circumferential direction 56 to swirl around the longitudinal axis 80 (e.g., rotational axis) of the gas turbine engine 12 to merge with the cavity fluid flow 78 to form a cooling medium 90 (e.g., cooling fluid flow). The cooling fluid flow 90 and/or the cavity fluid flow 78 may be directed toward the wheel space 64 and/or the rotor joint 72. In particular, a portion of the cooling fluid flow 90 may flow through the cavity 76 to interact with and cool the wheel space 64 and/or the rotor joint 72.

Figure 3:
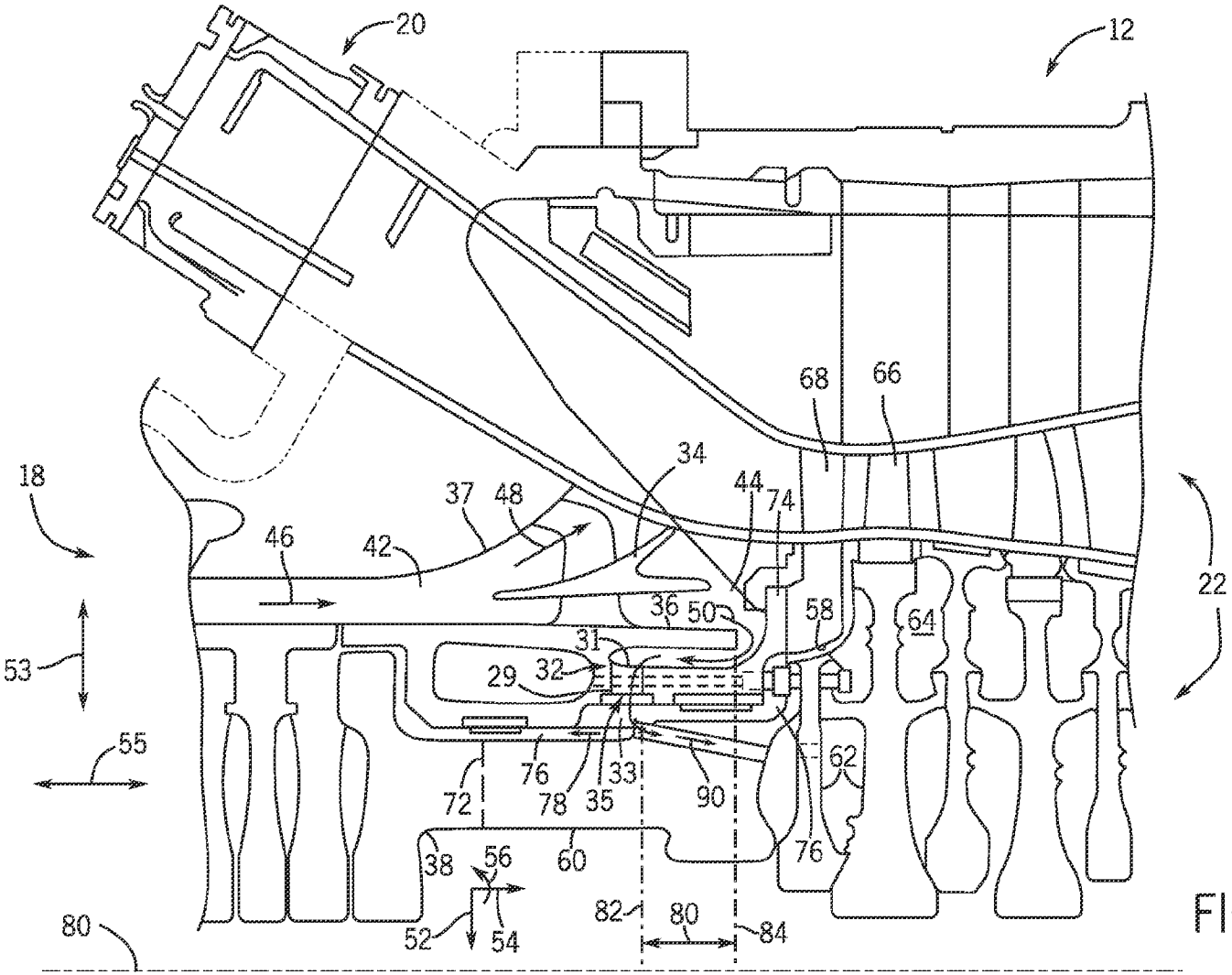
FIG. 3 is a partial cross-sectional side view of an embodiment of the gas turbine engine of FIG. 1 that includes an inducer assembly having at least one flow passage or inducer (e.g., axial-to-radial inducer)

FIG. 3 is a partial cross-sectional side view of an embodiment of a portion of the gas turbine engine 12 having the fluid flow inducer assembly 32 having one or more inducers 29 (e.g., axial-to-radial inducers) for routing cooling fluid flow (e.g., air flow) toward the turbine section 22 of the engine 12. Although discussed in relation to the gas turbine engine 12, the inducer assembly 32 or the inducers 29 may be used in other applications. As with the embodiment described above in FIG. 2, the gas turbine engine 12 includes the compressor 18, the combustor section 20, and the turbine 22. The compressor 18 includes a first wall 36, a portion of which may be known as a compressor discharge casing or compressor stator component, and an inner rotor component 38 (e.g., compressor rotor). A diffuser 34 at least partially defined by the first wall 36 and a second wall 37, which may also be known as an outer casing, is located aft or downstream of the compressor 18. The first wall 36 defines the inner boundary of the diffuser 34, meaning that the first wall 36 defines a boundary that it closer to a longitudinal axis 80 than the second wall 37. The illustrated first wall 36 may be generally straight (e.g., parallel to the axis 80), such that the first wall 36 has a cylindrical or annular shape. The second wall 37 defines the outer boundary of the diffuser 34. The second wall 37 diverges from the longitudinal axis 80 as it moves in the axial direction 54 such that the second wall 37 has a diverging annular shape. The shape of either the first wall 36 or the second wall 37 may be different than shown in FIG. 2. For instance, the first wall 36 be angled in the radial direction 52 (e.g., converging toward or diverging away from the longitudinal axis 80) as it moves in the axial direction 54. Also, the second wall 37 may include a cylindrical shape. However, in certain embodiment, the first and second walls 36 and 37 of the diffuser 34 may generally diverge from one another in the downstream axial direction 54, thereby causing diffusion of the compressed air flow in the axial and/or radial directions 54 and 52. Thus, the first and second walls 36 and 37 of the diffuser 34 may generally define an expanding annular passage.

As in FIG. 2, the gas turbine engine 12 of FIG. 3 includes various components for the turbine 22, such as wheels 62 and blades 66, 68. The adjoining ends of the compressor rotor 38 and the turbine rotor 60 may be joined (e.g., bolted together) to each other to form an inner rotary component or rotor 70. The rotor joint 72 may join the adjoining ends of the rotors 38, 60. The adjoining ends of the first wall 36 and the turbine stator component 58 may be coupled to each other (e.g., bolted together) to form the outer stationary casing 74 surrounding the rotor 70. In certain embodiments, the first wall 36 and the turbine stator component 58 form a singular component without using flanges or joints to form the casing 74. Thus, the components of the compressor 18 and the turbine 22 define the rotor 70 and the casing 74. As illustrated, the compressor and turbine components define the cavity 76 (e.g., annular cavity). However, depending on the location of the inducer assembly 32 or inducers 29, the cavity 76 may be defined solely by turbine components. For example, the inducer assembly 32 or inducer 29 may be disposed between turbine stages.

In the disclosed embodiments, the inducer assembly 32 facilitates cooling of the wheel space 64 and/or rotor joint 72. The inducer 29 may again be any type of inducer, including integrated inducers formed as a hole or passage in the casing 74. The inducer 29 may also include modular inducers that are formed to fit within the casing 74 and configured to be removed or replaced during servicing operations. In particular, the inducer assembly 32 receives a portion 50 of the fluid flow 46 from the compressor 18 via the diffuser 34 through an inducer inlet 31. The inducer assembly 32 directs the fluid flow portion 50 in a generally radial 52-to-axial 54 direction. This is explained further in the description related to FIG. 4. As described above with regard to FIG. 2, the gas turbine engine 12 forms a cavity 76 between the casing 74 and the rotor 70 during operation. The inducer outlet 33 may be positioned at a first longitudinal location 82 along the longitudinal axis of rotation 80. The outlet 44 of the diffuser 34, meanwhile, may be positioned at a second longitudinal location 84 at the distal end of the first wall 36, such as the illustrated position at the end of the first wall 36. The position of the inducer 29 (i.e., inducer inlet 31 and inducer outlet 33) may be underneath the first wall 36 in the radial direction 52.

Like the embodiment shown in FIG. 2, the first longitudinal location 82 may be forward (i.e., upstream of) the second longitudinal location 84. That is, the first longitudinal location 82 may be axially closer to the compressor 18 and axially further from the turbine 22. An overlap distance 86 shows the axial distance that the inducer assembly 32 is forward of the outlet 44 (i.e., the axial distance between the first 82 and second 84 longitudinal locations). The overlap distance 86 is not restricted only to the distance discernible from FIG. 2. The overlap distance 86 between the locations (i.e., first longitudinal location 82 and second longitudinal location 84) may be any distance suitable for a particular gas turbine engine 12. For example, the overlap distance 86 may be zero, whereby the inducer inlet 31 is axially aligned with the diffuser outlet 44. Having the inducer outlet 33 forward of the diffuser outlet 44 enables the inducer assembly 32 and diffuser 34 to occupy less longitudinal length. Additionally, the placement of the inducer assembly 32 underneath (e.g., radially inward from) the first wall 36 may enable the gas turbine engine 12 to occupy less radial 52 space, which reduces the height of the inducer assembly 32 and/or the diffuser 34. Reducing the height and length of these sections (e.g., inducer assembly 32 and diffuser 34) of the gas turbine engine 12 enables the overall height and length of the gas turbine engine 12 to be reduced as well. Alternatively, the overall length of the gas turbine engine 12 may, of course, remain constant while the reduction in length of the diffuser/inducer is taken up by a proportional increase in the length of other sections of the gas turbine engine (e.g., intake 16, compressor 18, turbine 22, exhaust 24). Thus, the power output/unit length of the gas turbine engine 12 may be increased with the disclosed embodiments of the diffuser 34 and inducer assembly 32.

In certain embodiments, the inducer assembly 32 may receive the fluid flow portion 50 from a source (e.g., fluid flow source) external to the gas turbine 10 (e.g., waste fluid from an IGCC system). In addition, the inducer 29 directs the fluid flow portion 50 (e.g., inducer fluid flow) in a substantially circumferential direction 56 to swirl around the longitudinal axis 80 (e.g., rotational axis) of the gas turbine engine 12 to merge with the cavity fluid flow 78 to form a cooling medium 90 (e.g., cooling fluid flow). The cooling fluid flow 90 and/or the cavity fluid flow 78 may be directed toward the wheel space 64 and/or the rotor joint 72. In particular, a portion of the cooling fluid flow 90 may flow through the cavity 76 to interact with and cool the wheel space 64 and/or the rotor joint 72.

Figure 4:
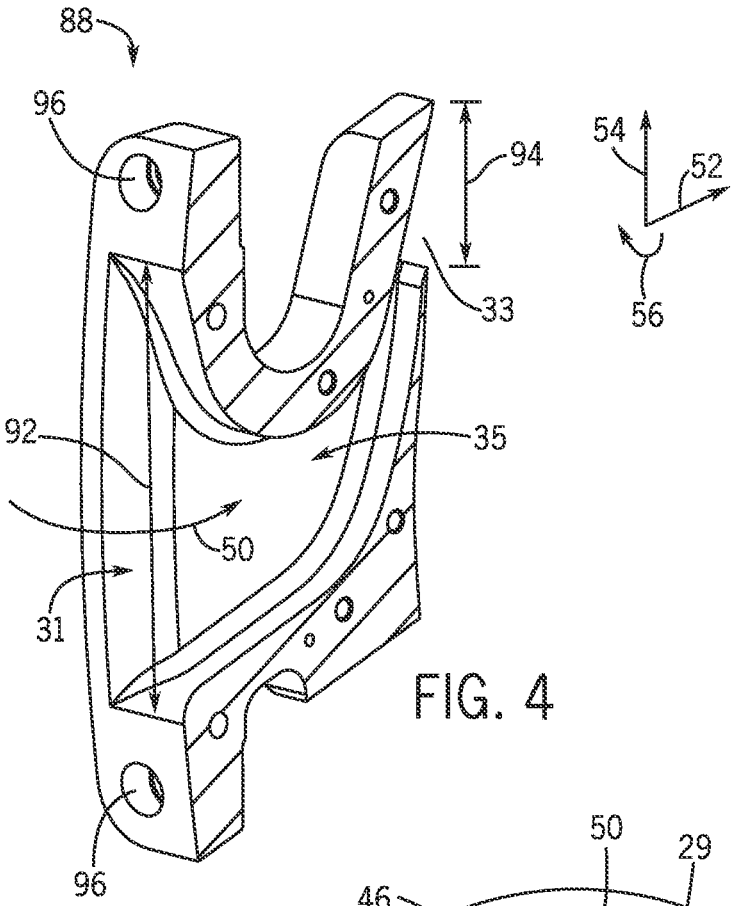
FIG. 4 is a cross-sectional view of an embodiment of an inducer, taken along line 4-4 of FIG. 3.

FIG. 4 is a cross-sectional view of an embodiment of an inducer 88 of the inducer assembly 32. The inducer 88 shown in FIG. 4 may be a modular inducer that is configured to be removable from the casing 74 when the engine 12 is not in operation. For example, during service operation, the casing 74 may be separated from the rotor 70, facilitating access to the inducer 88 and the inducer assembly 32. The inducer 88 may be installed using attachment means secured through the bolt holes 96. The inducer 88 includes the inlet 31 and the outlet 33 shown in FIGS. 2 and 3. The inducer 88 guides the fluid flow portion 50 through the flow passage 35 toward the cavity 76, as described above. The fluid flow portion 50 then exits the inducer assembly 32 through the inducer outlet 33 and directs the fluid flow portion 50 into the cavity 76 to generate the cavity fluid flow 78. The illustrated inducer 88 demonstrates a radial-to-axial inducer. That is, the fluid flow 50 flows first in a radial direction 52 but is then directed by the flow passage 35 in the axial direction 54. Other inducers 88 may be includes that have a flow passage 35 that directs the fluid flow 50 in the radial direction 52 or in the axial direction 54 only. Also as illustrated, the inducer 88 may include an inlet width 92 that is greater than an outlet width 94. The difference in widths (e.g., inlet width 92 and outlet width 94) may enable the fluid flow 50 to increase in velocity as it exits the outlet 33 and enters into the cavity 76. An increase in fluid flow velocity may provide more convective cooling fluid flow which results in faster cooling to the turbine section 22 as the fluid flow 50 would reach the turbine section 22 more quickly. Also, some embodiments may also include inducers 88 that provide a circumferential 56 turn, which induces a swirl in the same direction that the rotor 70 rotates. This circumferential 56 swirl enables less drag on the rotor 70 as it rotates around the longitudinal axis 80.

Figure 5:
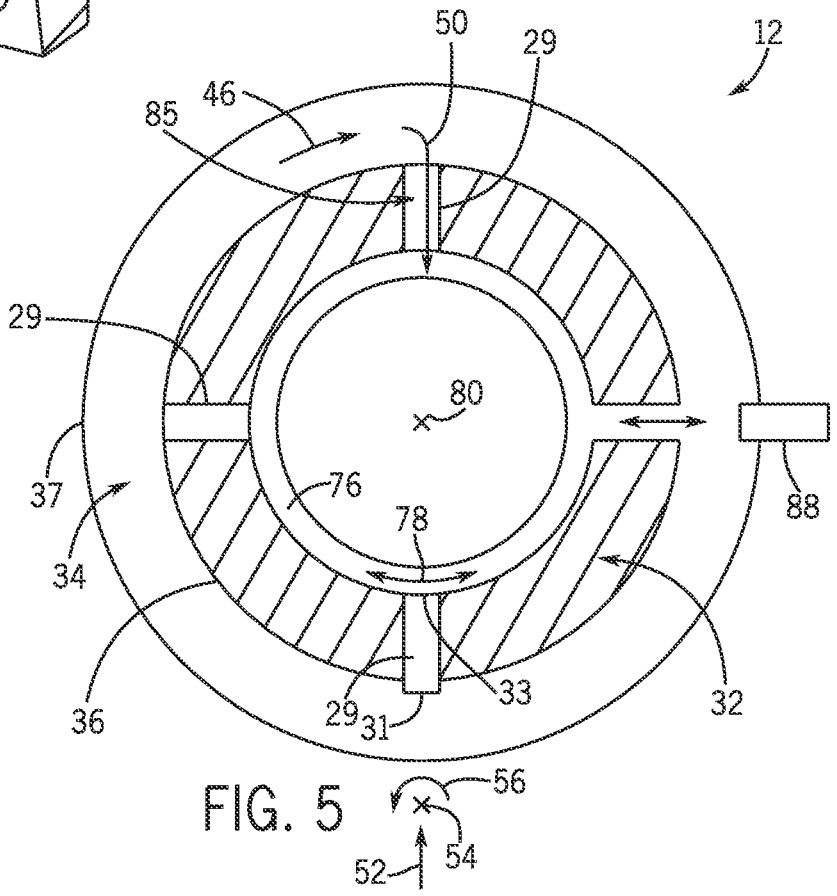
FIG. 5 is a schematic diagram of a cross-sectional view of an embodiment of the gas turbine engine of FIG. 1 that includes an inducer assembly having a plurality of flow passages (e.g., integral and removable inducers).

FIG. 5 is a schematic diagram of an embodiment of the gas turbine engine 12 of FIG. 1 that includes the diffuser 34 and the inducer assembly 32 having a plurality of flow passages 35 (e.g., modular inducers 88). As illustrated, the diffuser 34 includes the first wall 36 axially closer to the longitudinal axis 80 and the second wall 37 axially further from the longitudinal axis 80. Also as illustrated, the inducer assembly 32 includes four inducers 29, 88 spaced circumferentially about the axis 80. Other embodiments may include more or fewer inducers 29, 88. For example, the inducer assembly 32 may include 1, 2, 3, 10, 25, or more inducers 29, 88. Each inducer 29 may include the inlet (e.g., inlet 31) and the outlet (e.g., outlet 33). As illustrated, the inducers 29, 88 may be modular inducer cartridges. The modular inducer cartridges may be removable as demonstrated by inducer 88, which is shown partially removed from the inducer assembly 32. The inducers 29 may enable the fluid flow 46 to flow through the inducer flow passage 35 to the cavity 76. The inducers 29, 88 may be installed forward of an outlet 44 to the diffuser 34, which allows the diffuser 34 and/or the inducer assembly 32 to take up less space longitudinally 54 and/or radially 52.

Technical effects of the disclosed embodiments include providing an inducer assembly 32 having one or more inducers 29, 88 (e.g., axial, axial-to-radial, or radial inducers) for the gas turbine engine 12. In particular, the inducer assembly 32 may enable an increase in the overall efficiency of the gas turbine engine 12 by minimizing the longitudinal length of the diffuser 34 and inducer assembly 32 sections of the gas turbine engine 12. The inducer assembly 32 is disposed axially forward of the outlet 44 of the diffuser 34 and may include one or more inducers 29, 88. The shorter length of the diffuser 34 and inducer assembly 32 sections may enable other sections of the gas turbine engine 12 to increase in size and power generation, or may enable the gas turbine engine 12 to fit into areas with smaller size restrictions.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The invention claimed is:

1. A system comprising:

a gas turbine engine comprising:

a compressor;

a turbine;

a casing;

a rotor, wherein the casing and the rotor are disposed between the compressor and turbine, and the casing and the rotor define a cavity to receive a fluid flow from the compressor;

a diffuser disposed aft of the compressor, wherein the diffuser is configured to receive the fluid flow from the compressor, and the diffuser comprises a first inlet proximate the compressor and a first outlet distal from the compressor; and an inducer assembly comprising at least one inducer, wherein the at least one inducer comprises a flow passage configured to guide the fluid flow into the cavity, the flow passage comprises a second inlet configured to receive the fluid flow and a second outlet configured to discharge the fluid flow directly into the cavity, and both the second inlet and the second outlet are axially disposed forward of the first outlet of the diffuser.

2. The system of claim 1, wherein the diffuser is defined by a first wall and a second wall, wherein the first wall is radially disposed more proximate to a longitudinal axis of the gas turbine engine than the second wall, and the first wall is disposed between the diffuser and the at least one inducer.

3. The system of claim 2, wherein the second inlet and the second outlet of the at least one inducer are disposed radially inward from the first wall toward the longitudinal axis of the gas turbine engine.

4. The system of claim 2, wherein the second outlet of the at least one inducer is axially disposed forward of a distal end of the first wall, wherein the distal end of the first wall is adjacent the first outlet.

5. The system of claim 4, wherein the second inlet of the at least one inducer is axially disposed forward of the distal end of the first wall.

6. The system of claim 2, wherein the second inlet and the second outlet of the at least one inducer are disposed radially between the first wall and the longitudinal axis of the gas turbine engine.

7. The system of claim 1, wherein the at least one inducer comprises an axial inducer, an axial-to-radial diffuser, a radial diffuser, a radial-to-axial inducer, or any combination thereof.

8. The system of claim 1, wherein the at least one inducer is integral to the inducer assembly or removable from the inducer assembly.

9. A system comprising:

a gas turbine engine comprising:

a compressor;

a turbine;

a casing;

a rotor, wherein the casing and the rotor are disposed between the compressor and turbine, and the casing and the rotor define a cavity to receive a fluid flow from the compressor;

a diffuser disposed aft of the compressor, wherein the diffuser is configured to receive the fluid flow from the compressor, the diffuser is defined by a first wall and a second wall, the first wall being radially disposed more proximate to a longitudinal axis of the gas turbine engine than the second wall, and the diffuser comprises a first inlet proximate the compressor and a first outlet distal from the compressor; and an inducer assembly comprising at least one inducer, wherein the first wall is disposed between the diffuser and the at least one inducer, and wherein the at least one inducer comprises a flow passage configured to guide the fluid flow into the cavity, the flow passage comprises a second inlet configured to receive the fluid flow and a second outlet configured to discharge the fluid flow directly into the cavity, the second inlet and the second outlet are radially disposed more proximate to the longitudinal axis of the gas turbine engine than the first wall, and both the second inlet and the second outlet are axially disposed forward of the first outlet of the diffuser.

10. The system of claim 9, wherein the second outlet of the at least one inducer is axially disposed forward of a distal end of the first wall, wherein the distal end of the first wall is adjacent the first outlet.

11. The system of claim 10, wherein the second inlet of the at least one inducer is axially disposed forward of the distal end of the first wall.

12. The system of claim 9, wherein the second inlet and the second outlet of the at least one inducer are disposed radially inward from the first wall toward the longitudinal axis of the gas turbine engine.

13. A system comprising:

at least one inducer comprising a flow passage configured to guide a fluid flow into a cavity defined by a casing and rotor of a gas turbine engine, the flow passage comprises an inlet configured to receive the fluid flow from a compressor diffuser of the gas turbine engine, and an outlet configured to discharge the fluid flow directly into the cavity, wherein the at least one inducer is configured to be disposed within the gas turbine engine so that both the second inlet and the second outlet are axially disposed forward of a diffuser outlet of the compressor diffuser.

14. The system of claim 2, wherein the first wall comprises a first surface that interfaces with the cooling flow within the diffuser, a second surface disposed opposite the first surface, and a distal end of the first wall adjacent the first outlet, and wherein the gas turbine engine comprises a flow path for the fluid flow from the diffuser to the at least one inducer, and the flow path proceeds along a first surface of the first wall in a downstream direction, turns about the distal end in a radial direction, and proceeds along the second surface of the first wall towards the second inlet in an upstream direction.

15. The system of claim 9, wherein the first wall comprises a first surface that interfaces with the cooling flow within the diffuser, a second surface disposed opposite the first surface, and a distal end of the first wall adjacent the first outlet, and wherein the gas turbine engine comprises a flow path for the fluid flow from the diffuser to the at least one inducer, and the flow path proceeds along a first surface of the first wall in a downstream direction, turns about the distal end in a radial direction, and proceeds along the second surface of the first wall towards the second inlet in an upstream direction.

* * * * *